US010064530B2

(12) United States Patent
Krebs et al.

(10) Patent No.: US 10,064,530 B2
(45) Date of Patent: Sep. 4, 2018

(54) HANDHELD VACUUM CLEANER

(71) Applicant: BISSELL Homecare, Inc., Grand Rapids, MI (US)

(72) Inventors: Alan J. Krebs, Pierson, MI (US); Thomas K. Ankney, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 99 days.

(21) Appl. No.: 15/266,423

(22) Filed: Sep. 15, 2016

(65) Prior Publication Data

US 2017/0071426 A1 Mar. 16, 2017

Related U.S. Application Data

(60) Provisional application No. 62/219,349, filed on Sep. 16, 2015.

(51) Int. Cl.

| | |
|---|---|
| ***A47L 5/26*** | (2006.01) |
| ***A47L 9/04*** | (2006.01) |
| ***A47L 9/32*** | (2006.01) |
| ***A47L 9/24*** | (2006.01) |
| ***A47L 9/16*** | (2006.01) |
| ***A47L 5/24*** | (2006.01) |
| ***A47L 9/10*** | (2006.01) |
| ***A47L 9/12*** | (2006.01) |
| ***A47L 9/22*** | (2006.01) |

(52) U.S. Cl.

CPC ..... *A47L 9/322* (2013.01); *A47L 5/24* (2013.01); *A47L 9/102* (2013.01); *A47L 9/12* (2013.01); *A47L 9/127* (2013.01); *A47L 9/22* (2013.01)

(58) Field of Classification Search

CPC ... A47L 5/24; A47L 9/102; A47L 9/12; A47L 9/127; A47L 9/22; A47L 9/322

See application file for complete search history.

(56) References Cited

U.S. PATENT DOCUMENTS

| | | | | |
|---|---|---|---|---|
| 2,974,346 | A * | 3/1961 | Hahn | A47L 5/24 15/344 |
| 3,870,486 | A | 3/1975 | Eriksson et al. | |
| 3,877,902 | A | 4/1975 | Eriksson et al. | |
| 4,209,875 | A | 7/1980 | Pugh et al. | |
| 4,694,528 | A | 9/1987 | Comer et al. | |
| 4,704,765 | A | 11/1987 | Ataka | |
| 4,841,594 | A | 6/1989 | Elson et al. | |
| 4,876,763 | A | 10/1989 | Cho et al. | |
| 4,905,342 | A | 3/1990 | Ataka | |
| 4,967,443 | A | 11/1990 | Krasznai et al. | |

(Continued)

FOREIGN PATENT DOCUMENTS

| | | |
|---|---|---|
| CA | 2593950 | 6/2008 |
| CA | 2730437 | 9/2011 |

(Continued)

*Primary Examiner* — Marc Carlson
(74) *Attorney, Agent, or Firm* — McGarry Bair PC

(57) ABSTRACT

A handheld vacuum cleaner is provided with a hand-carriable body housing the components of a vacuum collection system. The vacuum collection system can include a working air path through the body, and includes a portion which passes through a handle of the hand-carriable body that is adapted to be gripped by a user during operation of the vacuum cleaner.

18 Claims, 12 Drawing Sheets

(56) References Cited

U.S. PATENT DOCUMENTS

| | | | | |
|---|---|---|---|---|
| 5,099,545 | A | 3/1992 | Krasznai et al. | |
| 5,134,751 | A | 8/1992 | Reed, Jr. et al. | |
| 5,337,443 | A | 8/1994 | Steinberg et al. | |
| 5,379,483 | A | 1/1995 | Pino | |
| 5,504,970 | A | 4/1996 | Neshat et al. | |
| 5,561,885 | A | 10/1996 | Zahuranec et al. | |
| 5,586,358 | A * | 12/1996 | Wolfe | A47L 5/26 15/334 |
| 5,787,546 | A * | 8/1998 | Bass | A47L 5/26 15/334 |
| 6,108,864 | A | 8/2000 | Thomas et al. | |
| 6,189,178 | B1 | 2/2001 | Roberts | |
| 6,347,428 | B1 | 2/2002 | Shimko et al. | |
| 6,536,075 | B1 * | 3/2003 | Bonnet | A47L 5/24 15/344 |
| 6,546,592 | B1 | 4/2003 | Cockburn et al. | |
| 7,162,770 | B2 | 1/2007 | Davidshofer | |
| 8,069,529 | B2 | 12/2011 | Groff et al. | |
| 8,146,201 | B2 | 4/2012 | Conrad | |
| 8,407,850 | B2 * | 4/2013 | Curien | A47L 1/08 15/344 |
| 8,782,850 | B2 | 7/2014 | Yoo et al. | |
| 2002/0073504 | A1 * | 6/2002 | Hall | A47L 1/08 15/320 |
| 2003/0005546 | A1 | 1/2003 | Bone | |
| 2003/0066156 | A1 | 4/2003 | Yang | |
| 2004/0211025 | A1 | 10/2004 | Jung et al. | |
| 2004/0216264 | A1 | 11/2004 | Shaver et al. | |
| 2005/0011038 | A1 | 1/2005 | Coburn | |
| 2005/0081321 | A1 | 4/2005 | Milligan et al. | |
| 2005/0138763 | A1 | 6/2005 | Tanner et al. | |
| 2005/0273972 | A1 | 12/2005 | Park | |
| 2007/0033765 | A1 | 2/2007 | Walker et al. | |
| 2008/0172993 | A1 | 7/2008 | Yun et al. | |
| 2008/0196194 | A1 | 8/2008 | Conrad | |
| 2009/0229070 | A1 | 9/2009 | Medema et al. | |
| 2009/0265877 | A1 | 10/2009 | Dyson et al. | |
| 2009/0305862 | A1 | 12/2009 | Yoo | |
| 2011/0099749 | A1 | 5/2011 | Chong et al. | |
| 2012/0011679 | A1 | 1/2012 | Chong et al. | |
| 2012/0030896 | A1 | 2/2012 | Crouch et al. | |
| 2012/0047683 | A1 | 3/2012 | Kim et al. | |
| 2012/0047858 | A1 | 3/2012 | Kim et al. | |
| 2012/0084939 | A1 | 4/2012 | Kim et al. | |
| 2012/0304417 | A1 | 12/2012 | Riley | |
| 2013/0091656 | A1 | 4/2013 | Smith | |
| 2013/0091815 | A1 * | 4/2013 | Smith | A47L 9/102 55/346 |
| 2013/0185892 | A1 | 7/2013 | Walker | |
| 2013/0269147 | A1 | 10/2013 | Conrad | |
| 2014/0007369 | A1 | 1/2014 | Williams et al. | |
| 2014/0082883 | A1 | 3/2014 | Tran | |
| 2014/0208538 | A1 | 7/2014 | Visel et al. | |
| 2014/0237757 | A1 | 8/2014 | Conrad | |
| 2016/0015227 | A1 | 1/2016 | Conrad et al. | |
| 2016/0015228 | A1 | 1/2016 | Conrad et al. | |
| 2016/0015229 | A1 | 1/2016 | Conrad et al. | |
| 2016/0015230 | A1 | 1/2016 | Conrad et al. | |
| 2016/0022101 | A1 | 1/2016 | Conrad | |

FOREIGN PATENT DOCUMENTS

| | | | | |
|---|---|---|---|---|
| CA | 2730437 | A1 * | 9/2011 | A47L 9/1683 |
| CA | 2675714 | | 1/2014 | |
| CN | 2812826 | Y | 9/2006 | |
| DE | 102011055668 | A1 | 5/2013 | |
| EP | 0529805 | B1 | 3/1993 | |
| EP | 1323370 | A3 | 7/2005 | |
| EP | 2529653 | A2 | 12/2012 | |
| JP | 3088011 | | 2/2002 | |
| JP | 2002238811 | A | 8/2002 | |
| JP | 2015089451 | A | 5/2015 | |
| WO | 08136575 | | 11/2008 | |
| WO | 10016672 | A2 | 11/2010 | |
| WO | 14195711 | A1 | 12/2014 | |

* cited by examiner

HANDHELD VACUUM CLEANER

CROSS-REFERENCE TO RELATED APPLICATION(S)

This application claims the benefit of U.S. Provisional Patent Application No. 62/219,349, filed Sep. 16, 2015, which is incorporated herein by reference in its entirety.

BACKGROUND

Vacuum cleaners can be embodied as portable or hand-carriable units. Many recent handheld vacuum cleaners use at least one cyclonic cleaning stage. Other handheld vacuum cleaners include non-cyclonic cleaning stages, such as filter bags.

BRIEF SUMMARY

In one aspect, the invention relates to a handheld vacuum cleaner including a hand-carriable body having an air inlet, an air outlet, and a handle adapted to be gripped by a user, a motor/fan assembly upstream of the air outlet and in fluid communication with the air inlet for generating a working airstream, a debris removal assembly, and a working air path through the body from the air inlet to the air outlet. The handle is at least partially hollow to form an air conduit, and a portion of the working air path extends through the air conduit formed by the handle

DESCRIPTION OF EMBODIMENTS OF THE INVENTION

The invention relates to vacuum cleaners. In one of its aspects, the invention relates to a handheld vacuum cleaner. In another aspect, the invention relates to a vacuum cleaner with a non-cyclonic debris removal assembly. For purposes of description related to the figures, the terms "upper," "lower," "right," "left," "rear," "front," "vertical," "horizontal," and derivatives thereof shall relate to the invention as oriented in FIGS. 1A-1B from the perspective of a user holding the handheld vacuum cleaner in a normal operating position. However, it is to be understood that the embodiments of the invention may assume various alternative orientations, except where expressly specified to the contrary.

Figure 1A:
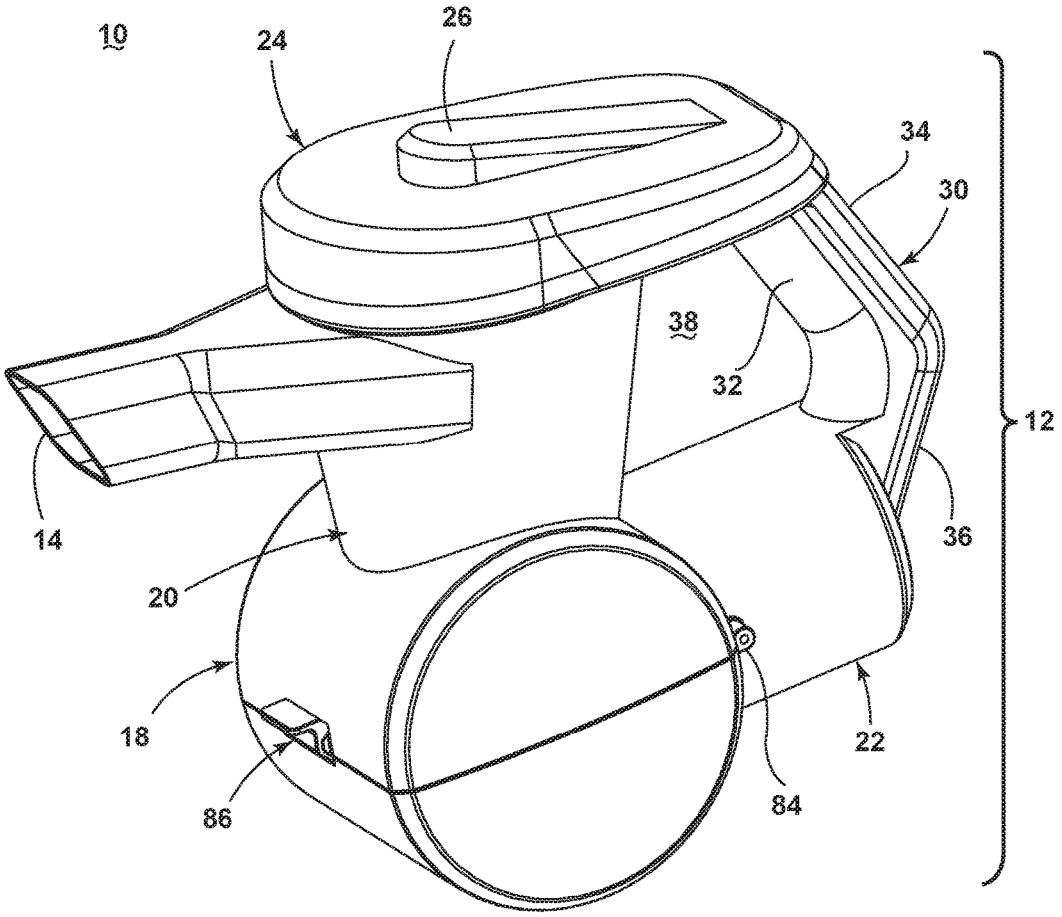
FIG. 1A is a front perspective view of a handheld vacuum cleaner according to a first embodiment of the invention.

FIG. 1A shows a front perspective view of a handheld vacuum cleaner 10 according to a first embodiment of the invention. The handheld vacuum cleaner 10 includes a hand-carriable body 12 housing the components of a vacuum collection system for creating a partial vacuum to suck up debris (which may include dirt, dust, soil, hair, and other debris) from a surface to be cleaned and collecting the removed debris in a space provided on the vacuum cleaner 10 for later disposal. Additionally, in some embodiments of the invention the vacuum cleaner 10 can have fluid delivery capability, including applying liquid or steam to the surface to be cleaned, and/or fluid extraction capability.

Figure 1B:
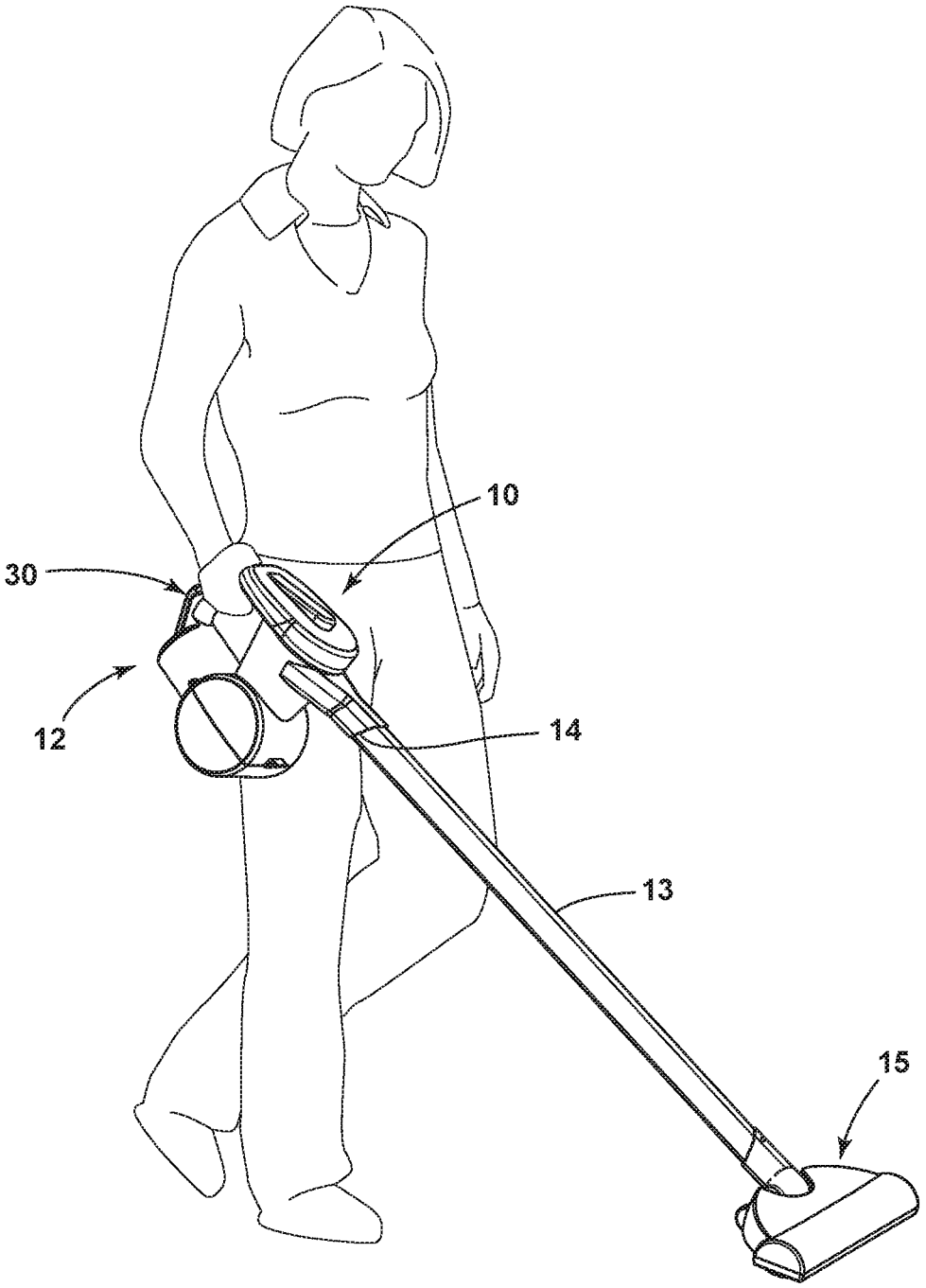
FIG. 1B is a schematic view showing an example of the handheld vacuum cleaner from FIG. 1A in use.

FIG. 1B is a schematic view showing an example of the handheld vacuum cleaner 10 in use. FIG. 1B shows the vacuum cleaner 10 in one example of a normal operating position. The vacuum collection system can include a working air path through the body 12, and may include an air inlet 14. The air inlet 14 may be in fluid communication with a suction inlet in a floor-engaging cleaning head or an accessory cleaning tool, as is conventionally known in the vacuum cleaner art. The cleaning head or tool can optionally be coupled with the air inlet 14 via a wand and/or a flexible vacuum hose, also as conventionally known in the vacuum cleaner art. Still further, the air inlet 14 may be used to directly clean a surface. In FIG. 1B, the handheld vacuum cleaner 10 is held by a user, an elongate wand 13 is coupled with the air inlet 14, and a tool in the form of a floor-engaging cleaning head 15 is coupled with the wand 13.

Figure 2:
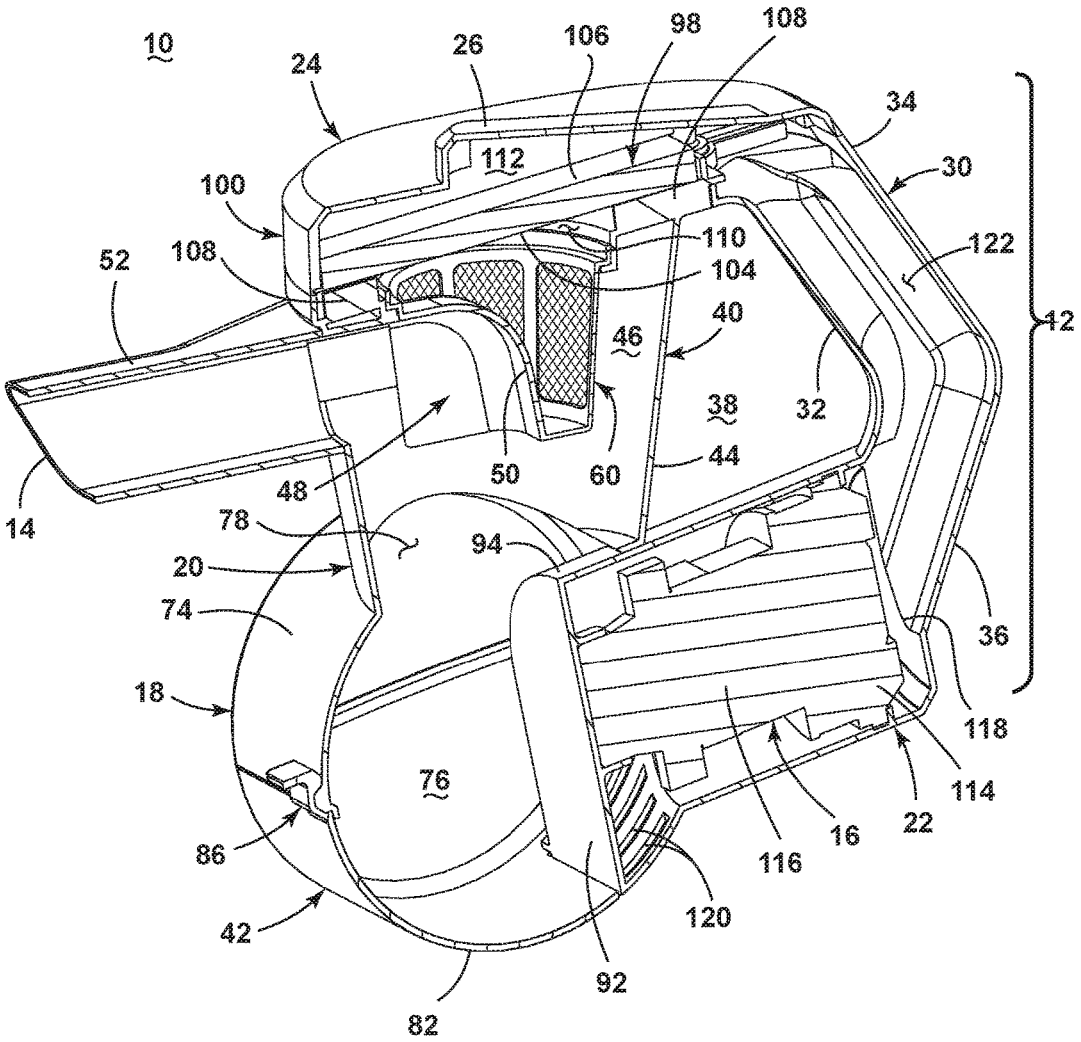
FIG. 2 is a cross-sectional view of the vacuum cleaner from FIG. 1A.

FIG. 2 is a cross-sectional view of the vacuum cleaner 10. In addition to the air inlet 14, the vacuum collection system may include one or more of a motor/fan assembly 16 in fluid communication with the air inlet 14 for generating a working airstream, and a debris removal assembly 18 for removing and collecting debris from the working airstream for later disposal, portions of which can define the working air path through the body 12.

The body 12 can include a first housing 20 for the debris removal assembly 18 and a second or motor housing 22 for the motor/fan assembly 16. The housings 20, 22 are in fluid communication with each other and can be integrally formed or otherwise secured together to form a single, hand-carriable unit. In the illustrated example, the housings 20, 22 are separately formed and then secured together, such as by welding or mechanical fasteners.

Figure 3:
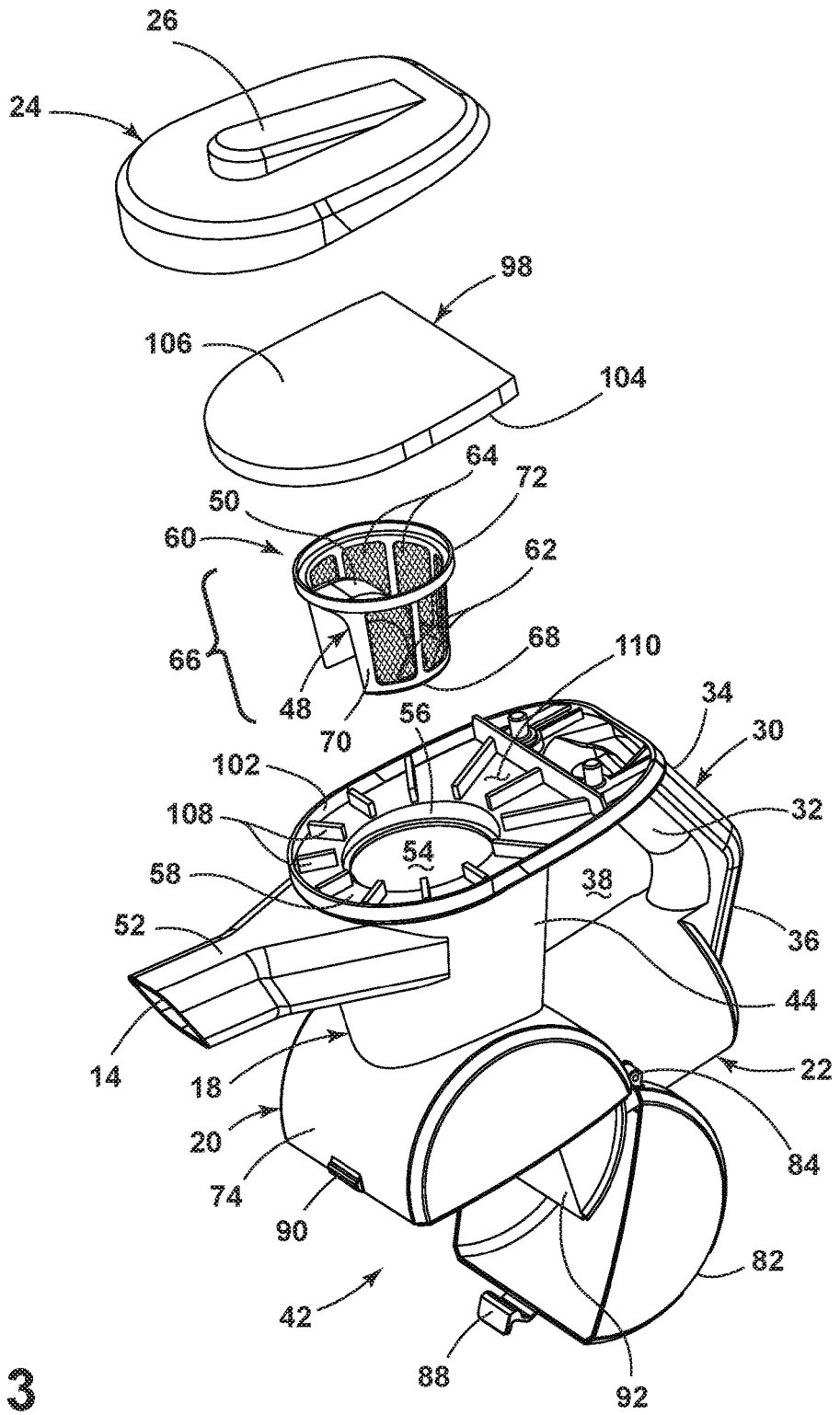
FIG. 3 is a partially exploded view of the vacuum cleaner from FIG. 1A.

A cover or lid 24 can enclose the top of the first housing 20 and can be openable to provide access to the top of the first housing 20. The lid 24 may be movable between a closed position, shown in FIGS. 1A-2, to an open position, one example of which is shown in FIG. 3. In the illustrated example, the entire lid 24 is removable from the housing 20, i.e. it is lifted entirely off the top of the housing 20. In this case, the lid 24 may have a friction or interference fit with the housing 20. In other embodiments, the lid 24 may be pivotally mounted to the housing 20 and rotatable from the closed position shown in FIGS. 1A-2 to an open position. To facilitate opening the lid 24, a handle or grip surface can be provided on the lid 24. As shown herein, a portion of the top of the lid 24 is raised to provide a grip surface 26.

A handle 30 can be provided on the body 12 to allow the user to grip, carry, and move the vacuum cleaner 10. The handle 30 can include a grip portion 32 and may be configured as a pistol-style grip that allows the user to grip the handle 30 in a comfortable, ergonomic position. The handle 30 can further have a first or upper end 34 attached to the first housing 20 and a second or lower end 36 attached to the second housing 22. The handle 30 defines a handle opening 38, with portions of the first housing 20 and motor housing 22 defining the handle opening 38 as well, such that the handle opening 38 is a closed loop. In a normal operating position, a user holds and maneuvers the vacuum cleaner 10 by gripping the handle 30, with a user's hand wrapping around the grip portion 32 and their fingers passing through the handle opening 38; one example of a normal operating position is shown in FIG. 1B. A portion of the lid 24 may form a portion of the handle 30, such as a portion of the upper end 34 of the handle 30 in the illustrated embodiment.

While not shown, a power switch for electrically coupling the motor/fan assembly 16 to a power source may be positioned or adjacent to a portion of the handle 30 so that a user can conveniently operate the switch with the same hand gripping the handle 30. For example, the switch, such as a trigger button, can be located on an inner surface of the grip portion 32. Alternatively, the power switch can be provided on another portion of the body 12. The power source may be a battery or a power cord connected to the body 12 and plugged into a household electrical outlet. In one preferred embodiment, a rechargeable battery is provided within the body 12 for convenient handheld operation of the vacuum cleaner 10.

The debris removal assembly 18 can include a debris separator 40 for separating contaminants from a working airstream and a debris collector 42 for receiving and collecting separated contaminants. The debris separator 40 can be provided in an upper portion of the housing 20, and the debris collector 42 can be defined by a lower portion of the housing 20. In the illustrated embodiment, the debris removal assembly 18 is non-cyclonic. Alternatively, the debris removal assembly 18 can include a cyclonic or centrifugal separator, a flexible and air-permeable filter bag, or other air filtering means.

As illustrated, the upper portion of the housing 20 can be defined by an exterior wall 44. The exterior wall 44 defines a chamber 46 for the debris separator 40. An air deflector 48 is provided in the chamber 46, and directs working air from the air inlet 14 downwardly within the chamber 46.

In the illustrated embodiment, the air deflector 48 is located to directly oppose the air inlet 14, and is sized such that all or a majority of the incoming working air encounters and is directed by the air deflector 48. The air deflector 48 includes a deflector wall 50 which can be curved, angled, bent, or otherwise shaped to effect a change in direction of the working air. The deflector wall 50 can be configured with a deflection angle of 30-120 degrees, and more particularly of about 90 degrees as shown in the illustrated embodiment. Further, in the illustrated embodiment the deflector wall 50 may be smoothly curved to create less turbulence, airflow resistance, and noise than a flat or angled wall may other produce. Also, an angled wall may tend to collect fine debris along the inside corner of the angled wall.

The air inlet 14 can be defined by a conduit 52 extending from the exterior wall 44. The conduit 52 extends normally or radially from the exterior wall 44, i.e. not tangentially, such that air is directed toward the centerline or central axis of the chamber 46. In other embodiments of the debris removal assembly 18, such as when the debris removal assembly 18 includes a cyclonic or centrifugal separator, the air inlet 14 can be configured to direct air tangentially around the circumference of the chamber 46.

The conduit 52 can form a connector which can detachably connect with a wand, hose, cleaning head, accessory tool or other accessory. Optionally, the conduit 52 can be provided with an electrical connector for allowing a cleaning head, accessory tool or other accessory coupled with the body to be powered. For example, an agitator or brushroll within a cleaning head can be powered for rotation.

FIG. 3 is a partially exploded view of the vacuum cleaner 10. An air outlet 54 for the debris removal assembly 18 provides fluid communication between the chamber 46 and the downstream motor/fan assembly 16, and forms part of the working air path through the body 12. The air inlet 14 and the air outlet 54 are provided near the upper end of the housing 20, with the air outlet 54 above the air inlet 14. As shown in FIG. 3, the air outlet 54 can be formed by an opening 56 in a top wall 58 of the first housing 20.

The debris separator 40 can further include a filter or screen associated with the air outlet 54 for filtering contaminants from the working airstream. For example, a filter 60 can be mounted at the top of the chamber 46, over the air outlet 54, and has at least one opening 62 covered by a screen 64, such as a wire mesh. The filter 60 can be provided as a filter cup, with a cylindrical housing 66 having a bottom wall 68 and a peripheral side wall 70 extending upwardly from the bottom wall 68. In the illustrated embodiment, the bottom wall 68 is closed to air flow, and the peripheral side wall 70 comprises multiple openings 62 covered by screen 64. Alternatively, one or more openings covered by screen can be provided in the bottom wall 68, or all of the openings can be provided in the bottom wall 68, with the peripheral side wall 70 being closed to air flow. It is further noted that the screen 64 can have differently-sized perforations, such that the mesh size of the screen 64 can vary around the filter 60.

The air deflector 48 may be formed with or otherwise provided on the filter 60. In the illustrated embodiment, the cylindrical housing 66 includes the air deflector 48, with the air deflector 48 formed as part of the peripheral side wall 70. Alternatively, the air deflector 48 may be separate from the filter 60.

The filter 60 may be slidably mounted in the air outlet 54, such that the filter 60 may be removed through the top of the housing 20 for cleaning or replacement when the lid 24 is open, as shown in FIG. 3. An upper edge of the peripheral side wall 70 can include at least one flange or lip 72 projecting radially therefrom. The peripheral side wall 70 may further be tapered such that the lower end of the cylindrical housing 66 has a smaller diameter than the upper end near the lip 72. The tapered shape may aid in insertion of the filter 60 into the outlet opening 56 of the housing 20.

When the filter 60 is seated within the housing 20, the lip 72 on the peripheral side wall 70 is seated in the outlet opening 56, with the majority of the filter 60 projecting downwardly into the chamber 46. The filter 60 may be provided with a key or other orientation features to ensure that the deflector 48 is properly located toward the air inlet 14 when the filter 60 is seated within the outlet opening 56.

It is noted that the debris separator 40 illustrated herein includes both the air deflector 48 and the filter 60. In other embodiments, the debris separator 40 can include only the air deflector 48 or only the filter 60. Other configurations of the debris separator 40 are also possible.

With reference to FIGS. 2-3, the debris collector 42 receives and collects separated contaminants (i.e. debris)

from the debris separator 40. The collected debris may have been separated from the working airflow by the air deflector 48 or the filter 60. The filter 60 may also retain some debris on the cylindrical housing 66 rather than being collected in the debris collector 42.

As illustrated, the lower portion of the housing 20 forming the debris collector 42 can be defined by an exterior wall 74. The exterior wall 74 defines a collection chamber 76 for the debris collector 42. In the illustrated embodiment, the exterior wall 74 defines a generally cylindrical collection chamber 76 oriented perpendicular to the chamber 46. Alternatively, other configurations of the debris collector 42 relative to the debris separator 40 are possible.

The lower end of the exterior wall 44 forms a debris outlet 78 from the chamber 46 through which debris from the chamber 46 may fall into the collection chamber 76. The debris outlet 78 may also be considered an inlet to the collection chamber 76. The debris outlet 78 is provided below the air inlet 14 and the air outlet 54.

The lower exterior wall 74 may be provided with an openable door or other means for emptying the collection chamber 76. In the illustrated embodiment, the exterior wall 74 includes an openable lower section forming an openable door 82 that can be opened to empty the collection chamber 76. The door 82 may also serve as the bottom of the first housing 20.

The debris collector 42 may be emptied by opening the door 82. The door 82 can be coupled with another portion of the body 12 by a hinge 84, such as the motor housing 22 in the illustrated embodiment or alternatively with the upper section of the exterior wall 74 or another portion of the first housing 20. The door 82 can be pivoted to an open position shown in FIG. 3 for emptying the contents of the collection chamber 76. The door 82 can be secured in the closed position by a releasable latch 86. In the illustrated embodiment the hinge 84 is provided on a back side of the debris collector 42 and the latch 86 is provided on a front side of the debris collector 42, such that when the latch 86 is released, the door 82 swings rearwardly to open.

The latch 86 can include a deflectable hook 88 on one of the door 82 or the upper section of the exterior wall 74, and a catch 90 on the other of the door 82 or the upper section of the exterior wall 74. Other embodiment of latches 86, such as a pivoting push-button that releases a catch, may be used.

Referring to FIG. 2, a portion of the motor housing 22 may project into and form a portion of the debris collector 42. In the illustrated embodiment, a forward wall 92 of the motor housing 22 defines a portion of the collection chamber 76, as well as a portion of a top wall 94 of the motor housing 22. The exterior wall 74 of the debris collector 42 may also overlap a portion of the motor/fan assembly 16 within the motor housing 22. Having a portion of the motor housing 22 overlap a portion of the debris collector 42 forms a more compact body 12 and positions the handle 30 closer to the center of gravity of the vacuum cleaner 10. This arrangement reduces the magnitude of downward forces and torque on a user's hand and wrist, which makes the vacuum cleaner 10 easier to handle and manipulate. A substantial portion of the motor/fan assembly 16 may remain rearward of the debris collector 42 and the debris separator 40.

A pre-motor filter assembly can be provided downstream of the debris separator 40 and upstream of the motor/fan assembly 16, with the working air path extending through the pre-motor filter assembly. The pre-motor filter assembly and includes at least one pre-motor filter 98 received within a pre-motor filter chamber 100. The pre-motor filter 98 can be provided above the chamber 46, including above the air outlet 54.

The pre-motor filter chamber 100 is provided at an upper portion of the first housing 20, and may include the top wall 58 of the first housing 20 and a perimeter wall 102 extending from the top wall 58 and defining an opening for the filter 98. The pre-motor filter chamber 100 can be closed by the lid 24; when closed, the lid 24 can define a top or upper wall of the pre-motor filter chamber 100.

In the illustrated embodiment, the pre-motor filter chamber 100 is formed by an upper portion of the first housing 20, such that it is not removable or separable from the first housing 20. Alternatively to being formed by the first housing 20, a separate pre-motor filter housing can be provided, and may be removable from the first housing 20 so that a user need not directly touch the filter 98 to remove it from the vacuum cleaner 10.

The pre-motor filter 98 includes an upstream side 104 and a downstream side 106. The upstream side 104 faces the air outlet 54, and the downstream side 106 opposes the upstream side 104 relative to the direction of airflow. In the illustrated embodiment, the filter 98 is flat and substantially uninterrupted, unlike ring-shaped filters which have a hole or opening defining the upstream side of the filter. The pre-motor filter 98 can comprise a foam filter or a HEPA filter. A foam filter has the advantage of being reusable with periodic cleaning.

Stand-offs 108 can be provided on the upper portion of the first housing 20 and/or on the underside of the lid 24 to engage the upstream and/or downstream sides 104, 106 of the pre-motor filter 98 to secure the filter 98 in position. In the illustrated embodiment, the stand-offs 108 include ribs projecting from the top wall 58 of the housing 20, about the outlet opening 56. The stand-offs 108 define an upstream headspace or header 110 on the upstream side 104 of the pre-motor filter 98 that allows air flowing out of the air outlet 54 to travel laterally between the stand-offs 108. A downstream headspace or header 112 on the downstream side 106 of the pre-motor filter 98 is formed by the open space between the underside of the lid 24 and the downstream side 106 of the pre-motor filter 98.

The pre-motor filter 98 may be removably mounted in the filter chamber 100, such that the pre-motor filter 98 is removed through the top of the housing 20 for cleaning or replacement when the lid 24 is open, as shown in FIG. 3. With the pre-motor filter 98 removed, the filter cup 60 may also be removed through the top of the housing 20 as described above.

When the lid 24 is open, the downstream side 106 of the pre-motor filter 98 is viewable by a user. Alternatively, the pre-motor filter assembly can be configured such that the upstream side 104 is visible when the lid 24 is open. For example, the pre-motor filter 98 may be coupled with the underside of the lid 24, such that the pre-motor filter 98 remains with the lid 24 when the lid 24 is open. This allows the user to immediately view the upstream side 104 and assess whether the pre-motor filter 98 should be cleaned or replaced. One example of such a filter arrangement is disclosed in U.S. Patent Application Publication No. 2015/0182085, published Jul. 2, 2015, which is incorporated herein by reference in its entirety.

Portions of the body 12 may be at least partially transparent or translucent in order to permit a user to view an interior portion of the body 12. For example, at least a portion of the debris collector 42 may be formed of a transparent material, such as plastic, so that a user can determine the fullness of the collection chamber 76 without having to open the collection chamber 76. Also, at least a portion of the lid 24 may be formed of a transparent material, such as plastic, so that a user can visually inspect the condition of the pre-motor filter 98 without having to open the lid 24.

Referring to FIG. 2, the motor/fan assembly 16 is provided in fluid communication with the debris removal assembly 18, and is positioned downstream of the debris removal assembly 18 and pre-motor filter assembly, within the motor housing 22. The vacuum collection system can also be provided with one or more additional filters (not shown) upstream or downstream of the motor/fan assembly 16. The motor/fan assembly 16 may further be below the pre-motor filter 98 and substantially below the chamber 46.

The motor/fan assembly 16 includes a fan section 114 and a motor section 116 which are housed in the motor housing 22. The motor housing 22 further comprises an inlet 118 for passing air into the motor housing 22 and an outlet for exhausting substantially clean air from the vacuum cleaner 10. The outlet therefore forms an air outlet of the working air path through the body 12. The motor housing inlet 118 may be located between the upper and lower ends of the first housing 20, and may preferably be below the chamber 46, such as between the upper and lower ends of the collection chamber 76. In the embodiment illustrated herein, the motor housing outlet is formed by one or more exhaust openings or grill 120 in the motor housing 22.

The working air path through the body 12 includes a portion connecting the air outlet 54 with the motor housing inlet 118 to the motor/fan assembly 16. This portion can include an air conduit 122 formed by the handle 30 which extends downstream of the downstream header 112 to the motor housing inlet 118. To form the air conduit, the handle 30 is at least partially hollow. As shown herein, the handle 30 may be substantially hollow between the upper end 34 and the lower end 36. It also noted that, as shown herein, the handle 30 may be substantially rigid between the upper end 34 and the lower end 36, in that the handle 30 will not flex or collapse under the grip of a user during normal operation of the handheld vacuum cleaner 10. In other embodiments, a portion of the handle 30 may be formed of a flexible hose or conduit.

In the illustrated embodiment, the working air path connecting the air outlet 54 with the motor housing inlet 118 can further include the pre-motor filter assembly, as well as the upstream and downstream headers 110, 112. From the downstream header 112, air may flow through air conduit 122 in a generally downward direction and into the motor housing inlet 118.

The air conduit 122 may be formed with no bends less than 90 degrees so as to avoid drastic changes in air flow direction which would otherwise cause airflow restrictions and noise. In one example, the bends at the upper end 34 and lower end 36 of the handle 30 may be between 105 and 150 degrees.

It is noted that in order to prevent air leakage, seals or gaskets can be provided between various components of the vacuum cleaner 10, including but not limited to, at the interface between the lid 24 and first housing 20, at the interface between the filter cup 60 and the outlet opening 56, at the door 82 of the debris collector 42, and/or at the interface between the motor/fan assembly 16 and the motor housing 22.

Figure 4:
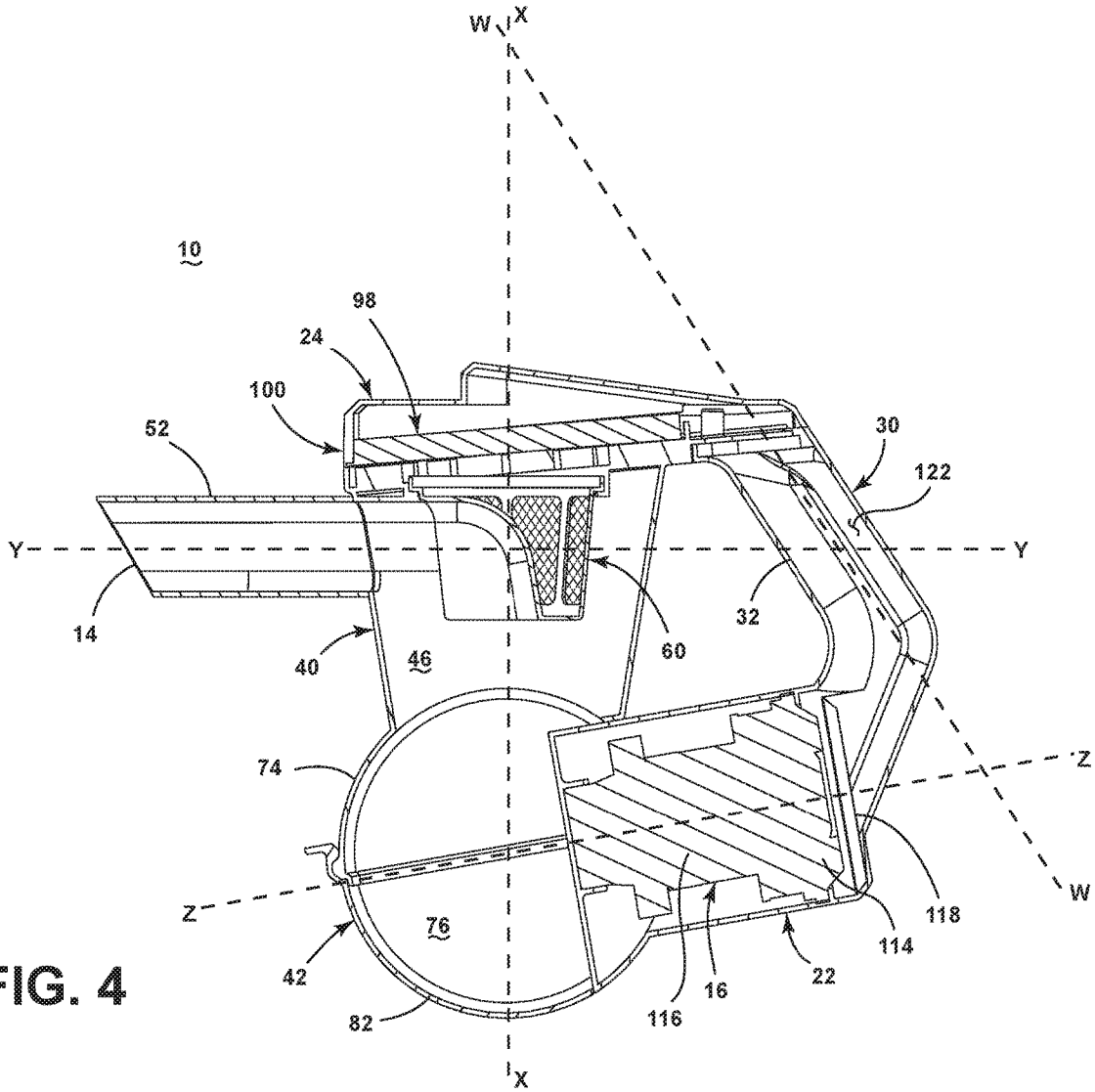
FIG. 4 is a side sectional view of the vacuum cleaner from FIG. 1A.

FIG. 4 is a side sectional view of the vacuum cleaner 10. The chamber 46 for the debris separator 40 defines a central longitudinal axis X. The central longitudinal axis X may pass through the air outlet 54. In the illustrated embodiment, the debris collector 42 extends generally perpendicular to the central longitudinal axis X, with the exterior wall 74 defining a generally cylindrical collection chamber 76 oriented perpendicular to the chamber 46. The pre-motor filter 98 can be provided above the chamber 46, including above the air outlet 54, with the central longitudinal axis X extending through the filter 98 and/or filter chamber 100. In the illustrated embodiment, the axis X extends through both the filter 98 and filter chamber 100.

In FIG. 4, the vacuum cleaner 10 is oriented with the central longitudinal axis X extending vertically. It is noted that this particular orientation is used as a reference point when discussing the other axes of the vacuum cleaner 10 for FIG. 4, and that in a normal operating position the vacuum cleaner 10 may be held at other orientations, such as, but not limited to, with the air inlet 14 pointing downwardly or at an angle; one example of a normal operating position is shown in FIG. 1B. With respect to the various axes discussed herein, the term "substantially" denotes that one axis may deviate from the described relationship by up to 20 degrees.

The air inlet conduit 52 can extend along an inlet axis Y that may be generally perpendicular to the central longitudinal axis X of the debris separator 40 and may further intersect the central longitudinal axis X. The air deflector 48 provided in the chamber 46 directs working air from the air inlet 14 downwardly within the chamber 46, generally along the central longitudinal axis X. Thus, the incoming working airstream initially follows inlet axis Y, and is turned to generally follow the central longitudinal axis X by the air deflector 48.

The fan section 114 and motor section 116 of the motor/fan assembly 16 lie along a common motor axis Z. Air traveling through the motor/fan assembly 16 travels substantially parallel to the motor axis Z. The fan section 114 may oriented rearwardly and above the motor section 116 along the motor axis Z.

The motor axis Z may be generally vertical, horizontal or between vertical and horizontal. Broadly, the motor axis Z may range from 0-90 degrees relative to the central longitudinal axis X, with a motor axis Z at 0 degrees being generally parallel to the central longitudinal axis X and a motor axis Z at 90 degrees being generally perpendicular to the central longitudinal axis X. Preferably, the motor axis Z may be generally horizontal or inclined from horizontal. A more preferred range for the motor axis Z may be 60-90 degrees relative to the central longitudinal axis X.

It is noted that the motor housing inlet 118 may lie along the motor axis Z or may deviate from the motor axis Z. For example, the angle of the motor housing inlet 118 may range from 0-90 degrees relative to the central longitudinal axis X. Further, the motor housing inlet 118 may point generally upwardly or downwardly relative to the central longitudinal axis X.

The motor axis Z may intersect the central longitudinal axis X, or may be offset from the central longitudinal axis X. In the illustrated embodiment, the motor axis Z passes through the collection chamber 76, with the intersection of the central longitudinal axis X occurring in the collection chamber 76. Further, the parting line defined by the door 82 of the debris collector 42 may be substantially parallel to the motor axis Z. Still further, the pre-motor filter 98 may be substantially parallel to the motor axis Z.

The grip portion 32 of the handle 30 may define a handle axis W. For a pistol-style grip, the handle axis W may be generally vertical, or inclined from the vertical. In the embodiment illustrated, the handle axis W is inclined forwardly from vertical and formed at an angle relative to the central longitudinal axis X. The angle may be approximately 0-45 degrees, and more preferably approximately 33 degrees as shown in the illustrated embodiment. The angled, pistol-style handle 30 positions the user's hand and wrist in an ergonomic position with more grip strength for holding the vacuum cleaner 10.

Together, the central longitudinal axis X, handle axis W, and motor axis Z define a triangle. As the motor/fan assembly 16 and the debris removal assembly 18 comprise the majority of the weight of the vacuum cleaner 10, moving the handle 30 closer to these components and arranging the handle 30 in a triangular relationship with these components decreases the distance between the handle 30 and the center of gravity of the vacuum cleaner 10. Moving the handle 30 closer to the center of gravity reduces the magnitude of downward forces and torque on a user's hand and wrist, which makes the vacuum cleaner 10 easier to handle and manipulate.

Figure 5:
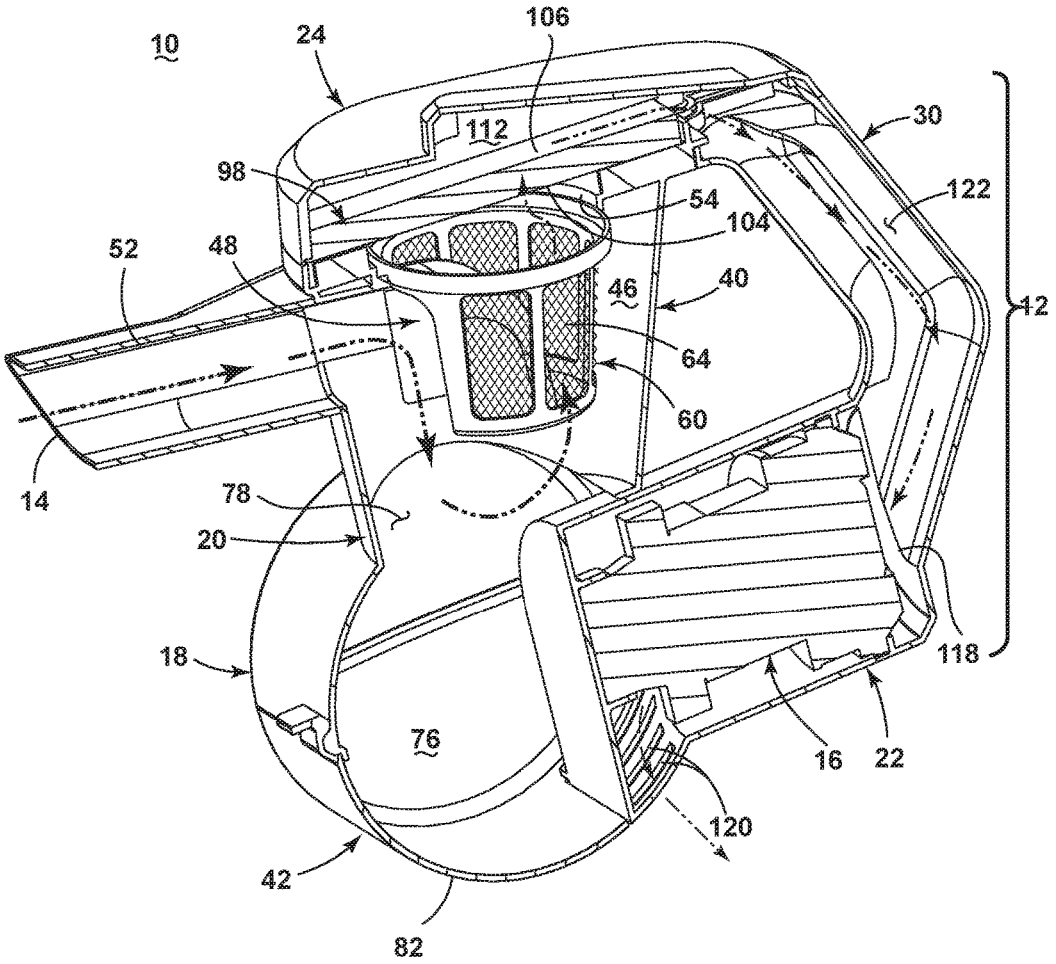
FIG. 5 is a partial cross-sectional view of the vacuum cleaner from FIG. 1A, showing a working air flow path through the vacuum cleaner.

The vacuum cleaner 10 shown in FIGS. 1A-5 can be used to effectively clean a surface by removing debris (which may include dirt, dust, soil, hair, and other debris) from the surface in accordance with the following method. Referring to FIG. 5 in particular, to perform vacuum cleaning, the motor/fan assembly 16 draws in debris-laden air through the air inlet 14 and into the debris removal assembly 18 where at least some or all debris in the working air is filtered out from the working airstream. As shown herein, a working airstream enters the air inlet 14 and is deflected downwardly within the chamber by the air deflector 48 and away from the filter 60. The air then travels upwardly to pass through the filter cup 60, which can retain at least some debris in the screen 64 or knock additional debris into the debris collector 42, and continues upwardly to exit the chamber via the air outlet 54. The air continues to travel upwardly through the pre-motor filter 98, traveling through the lower, upstream side 104 first and then through the upper, downstream side 106. The air then passes generally rearwardly through the downstream header 112 and travels through the air conduit 122 in the handle 30 to the motor/fan assembly 16 via inlet 118. After passing through the motor/fan assembly 16, the air may exit the housing via the exhaust grill 120.

In some embodiments, a post-motor filter (not shown) may be provided between the outlet from the motor/fan assembly 16 and the exhaust grill 120. In this case, a portion of the second housing 22 may be configured to provide access to the post-motor filter for cleaning or replacement of the post-motor filter. The debris removal assembly 18 can be periodically emptied of debris by opening the door 82 of the debris collector 42. Likewise, the filter cup 60 and pre-motor filter 98, as well as any additional filters, can periodically be cleaned or replaced.

Figure 6A:
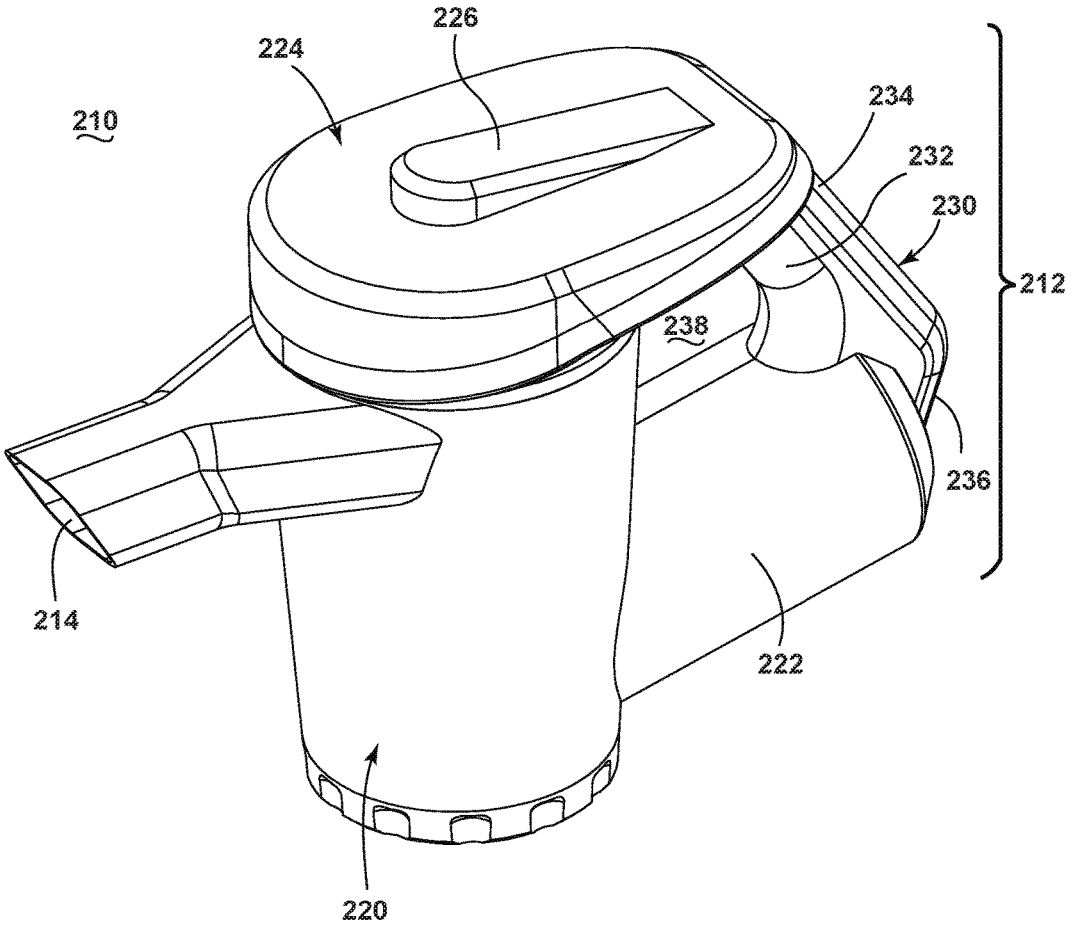
FIG. 6A is a front perspective view of a handheld vacuum cleaner according to a second embodiment of the invention.

FIG. 6A shows a front perspective view of a handheld vacuum cleaner 210 according to a second embodiment of the invention. The handheld vacuum cleaner 210 includes a hand-carriable body 212 housing the components of a vacuum collection system for creating a partial vacuum to suck up debris (which may include dirt, dust, soil, hair, and other debris) from a surface to be cleaned and collecting the removed debris in a space provided on the vacuum cleaner 210 for later disposal. Additionally, in some embodiments of the invention the vacuum cleaner 210 can have fluid delivery capability, including applying liquid or steam to the surface to be cleaned, and/or fluid extraction capability.

Figure 6B:
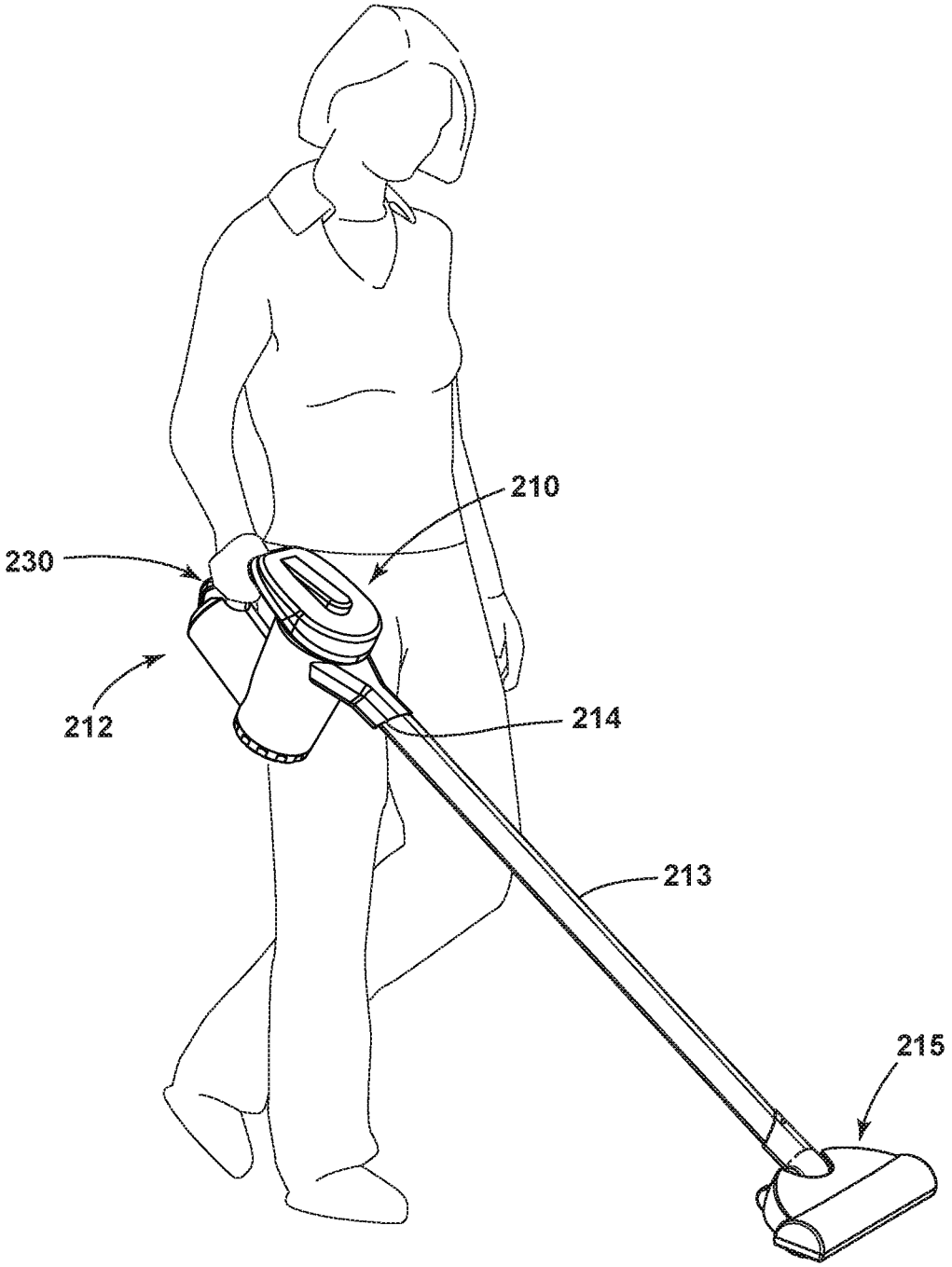
FIG. 6B is a schematic view showing an example of the handheld vacuum cleaner from FIG. 6A in use.

FIG. 6B is a schematic view showing an example of the handheld vacuum cleaner 210 in use. FIG. 6B shows the vacuum cleaner 210 in one example of a normal operating position. The vacuum collection system can include a working air path through the body 212, and may include an air inlet 214. The air inlet 214 may be in fluid communication with a suction inlet in a floor-engaging cleaning head or an accessory cleaning tool, as is conventionally known in the vacuum cleaner art. The cleaning head or tool can optionally be coupled with the air inlet 214 via a wand and/or a flexible vacuum hose, also as conventionally known in the vacuum cleaner art. Still further, the air inlet 214 may be used to directly clean a surface. In FIG. 6B, the handheld vacuum cleaner 210 is held by a user, an elongate wand 213 is coupled with the air inlet 214, and a tool in the form of a floor-engaging cleaning head 215 is coupled with the wand 213.

Figure 7:
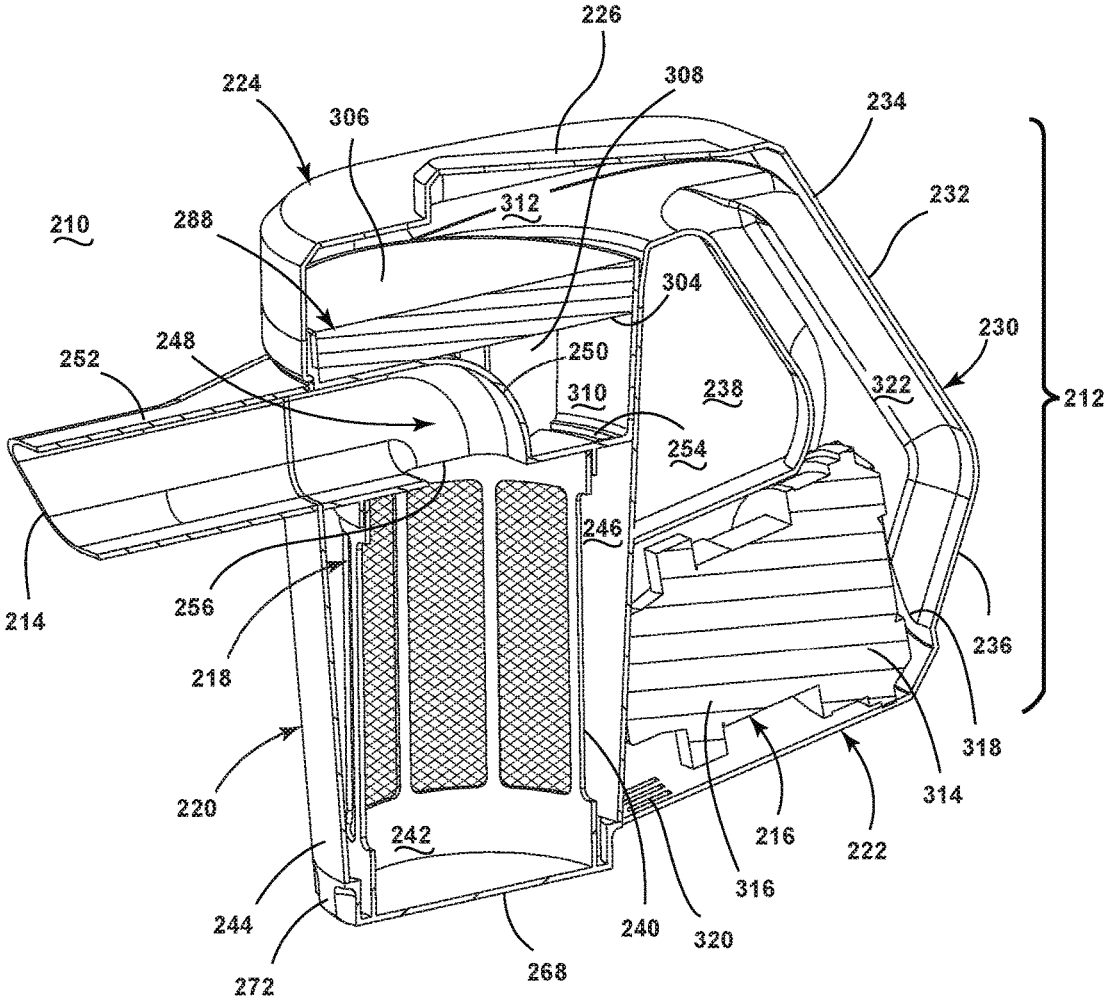
FIG. 7 is a cross-sectional view of the vacuum cleaner from FIG. 6A.

FIG. 7 is a cross-sectional view of the vacuum cleaner 210 from FIG. 6A. In addition to the air inlet 214, the vacuum collection system may include one or more of a motor/fan assembly 216 in fluid communication with the air inlet 214 for generating a working airstream, and a debris removal assembly 218 for removing and collecting debris from the working airstream for later disposal, portions of which can define the working air path through the body 12, The body 212 can include a first housing 220 for the debris removal assembly 218 and a second or motor housing 222 for the motor/fan assembly 216. The housings 220, 222 are in fluid communication with each other and can be integrally formed or otherwise secured together to form a single, hand-carriable unit. In the illustrated example, the housings 220, 222 are separately formed and then secured together, such as by welding or mechanical fasteners.

Figure 8:
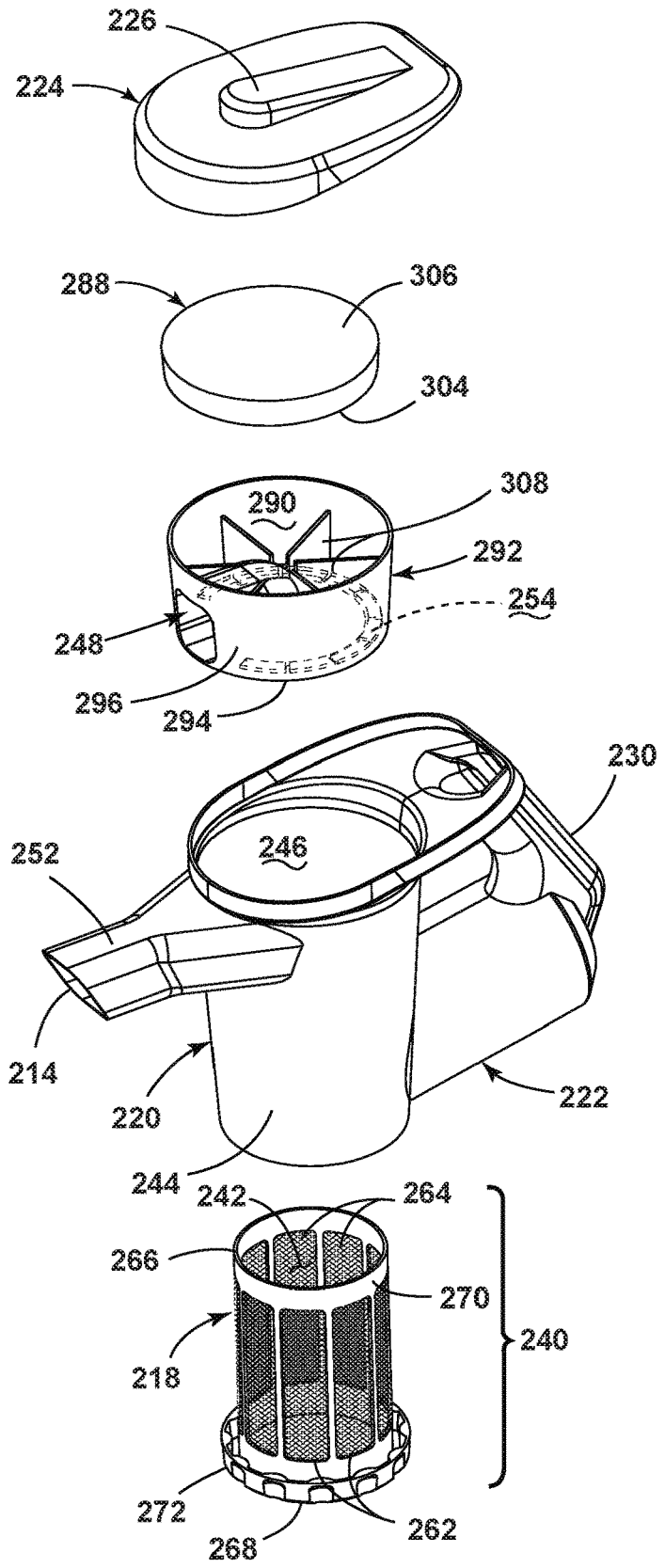
FIG. 8 is a partially exploded view of the vacuum cleaner from FIG. 6A.

A cover or lid 224 can enclose the top of the first housing 220 and can be openable to provide access to the top of the first housing 220. The lid 224 may be movable between a closed position, shown in FIGS. 6A-7, to an open position, one example of which is shown in FIG. 8. In the illustrated example, the entire lid 224 is removable from the housing 220, i.e. it is lifted entirely off the top of the housing 220. In this case, the lid 224 may have a friction or interference fit with the housing 220. In other embodiments, the lid 224 may be pivotally mounted to the housing 220 and rotatable from the closed position shown in FIGS. 6A-7 to an open position. To facilitate opening the lid 224, a handle or grip surface can be provided on the lid 224. As shown herein, a portion of the top of the lid 224 is raised to provide a grip surface 226.

A handle 230 can be provided on the body 212 to allow the user to grip, carry, and move the vacuum cleaner 210. The handle 230 can include a grip portion 232 and may be configured as a pistol-style grip that allows the user to grip the handle 230 in a comfortable, ergonomic position. The handle 230 can further have a first or upper end 234 attached to the first housing 220 and a second or lower end 236 attached to the second housing 222. The handle 230 defines a handle opening 238, with portions of the first housing 220 and motor housing 222 defining the handle opening 238 as well, such that the handle opening 238 is a closed loop. In a normal operating position, a user holds and maneuvers the vacuum cleaner 210 by gripping the handle 230, with a user's hand wrapping around the grip portion 232 and their fingers passing through the handle opening 238 one example of a normal operating position is shown in FIG. 6B. A portion of the lid 224 may form a portion of the handle 230, such as a portion of the upper end 234 of the handle 230 in the illustrated embodiment.

While not shown, a power switch for electrically coupling the motor/fan assembly 216 to a power source may be positioned or adjacent to a portion of the handle 230 so that a user can conveniently operate the switch with the same hand gripping the handle 230. For example, the switch, such as a trigger button, can be located on an inner surface of the grip portion 232. Alternatively, the power switch can be provided on another portion of the body 212. The power source may be a battery or a power cord connected to the body 212 and plugged into a household electrical outlet. In one preferred embodiment, a rechargeable battery is provided within the body 212 for convenient handheld operation of the vacuum cleaner 210.

The debris removal assembly 218 can include a filter cup 240 for separating contaminants from a working airstream and collecting separated contaminants. The filter cup 240 defines an interior 242 in which debris is collected. As illustrated, the housing 220 can be defined by an exterior wall 244. The exterior wall 244 defines a chamber 246 for the filter cup 240. An air deflector 248 is provided in the chamber 246, and directs working air from the air inlet 214 downwardly into the interior 242 of the filter cup 240.

In the illustrated embodiment, the air deflector 248 is located to directly oppose the air inlet 214, and is sized such that all or a majority of the incoming working air encounters and is directed by the air deflector 248. The air deflector 248 includes a deflector wall 250 which can be curved, angled, bent, or otherwise shaped to effect a change in direction of the working air. The deflector wall 250 can be configured with a deflection angle of 30-120 degrees, and more particularly of about 90 degrees as shown in the illustrated embodiment. Further, in the illustrated embodiment the deflector wall 250 may be smoothly curved to create less turbulence, airflow resistance, and noise than a flat or angled wall may other produce. Also, an angled wall may tend to collect fine debris along the inside corner of the angled wall.

The air inlet 214 can be defined by a conduit 252 extending from the exterior wall 244. The conduit 252 extends normally or radially from the exterior wall 244, i.e. not tangentially, such that air is directed toward the centerline or central axis of the chamber 246. Other configurations of the air inlet 214 are also possible. For example, in other embodiments the debris removal assembly 218 can include a cyclonic or centrifugal separator, and the air inlet 214 can be configured to direct air tangentially around the circumference of the chamber 246.

The conduit 252 can form a connector which can detachably connect with a wand, hose, cleaning head, accessory tool or other accessory. Optionally, the conduit 252 can be provided with an electrical connector for allowing a cleaning head, accessory tool or other accessory coupled with the body to be powered. For example, an agitator or brushroll within a cleaning head can be powered for rotation.

An air outlet 254 for the debris removal assembly 218 provides fluid communication between the chamber 246 and the downstream motor/fan assembly 216, and forms part of the working air path through the body 212. Further, in the illustrated embodiment the deflector wall 250 may be an extension of the air inlet conduit 252, and the air deflector 248 may direct air toward an opening 256 in a lower side of the air inlet conduit 252. The air inlet 214 and the air outlet 254 are provided near the upper end of the housing 220, with the air outlet 254 below the conduit 252 but substantially even with the opening 256 in the lower side of the air inlet conduit 252.

FIG. 8 is a partially exploded view of the vacuum cleaner 10. The filter cup 240 can include a filter or screen for filtering contaminants from the working airstream. For example, the filter cup 240 can have at least one opening 262 covered by a screen 264, such as a wire mesh. The filter cup 240 can have a cylindrical housing 266 having a bottom wall 268 and a peripheral side wall 270 extending upwardly from the bottom wall 268. In the illustrated embodiment, the bottom wall 268 is closed to air flow, and the peripheral side wall 270 comprises multiple openings 262 covered by screen 264. Alternatively, one or more openings covered by screen can be provided in the bottom wall 268, or all of the openings can be provided in the bottom wall 268, with the peripheral side wall 270 being closed to air flow. It is further noted that the screen 264 can have differently-sized perforations, such that the mesh size of the screen 264 can vary around the filter cup 240.

The filter cup 240 can be fluidly located between the air inlet 214 and the air outlet 254, such that the working airstream from the air inlet 214 passes through the filter cup 240 before reaching the air outlet 254. The filter cup 240 can be mounted in the chamber 246, with the bottom wall 268 forming the bottom wall of the housing 220 to close the chamber 246. Alternatively, the housing 220 can be provided with a separate bottom wall that is openable to access the filter cup 240.

The interior 242 of the filter cup 240 receives and collects debris separated from the working air flow; the debris may collect on the bottom wall 268. The upstream or inner surface of the screen 264 may also retain some debris. To empty the filter cup 240 and/or clean the screen 264, the filter cup 240 can be removed from the housing 220. Alternatively, the bottom wall 268 may be configured to open to empty collected debris without removing the entire filter cup 240.

The filter cup 240 may be slidably mounted in the housing 220, such that the filter cup 240 may be removed through the open bottom of the housing 220 for cleaning or replacement, as shown in FIG. 8. The lower edge of the peripheral side wall 270 can include at least one flange 272 projecting radially therefrom. When the filter cup 240 is seated within the housing 220, the flange 272 on the peripheral side wall 270 can couple with the bottom of the exterior wall 244, with the majority of the filter cup 240 projecting upwardly into the chamber 246. The filter cup 240 may be provided with a mechanical coupling or other structure to ensure that the filter cup 240 is locked or otherwise secured to the housing 220. Some non-limiting examples of a mechanical coupling for the filter cup 240 include a bayonet coupling, a threaded coupling, a push-button latch, or a friction or interface fit with the housing 220.

Referring to FIGS. 7-8, a pre-motor filter assembly can be provided downstream of the debris removal assembly 218 and upstream of the motor/fan assembly 216, with the working air path extending through the pre-motor filter assembly. The pre-motor filter assembly includes at least one pre-motor filter 288 received within a pre-motor filter chamber 290. The pre-motor filter chamber 290 can be provided above the chamber 246, including above the air outlet 254. The pre-motor filter chamber 290 can be closed by the lid 224; when closed, the lid 224 can define a top or upper wall of the pre-motor filter chamber 290.

The pre-motor filter chamber 290 of the illustrated embodiment can be defined at least in part by a filter housing 292 which is received at an upper portion of the first housing 220, and may include a bottom wall 294 and a peripheral side wall 296 extending upwardly from the bottom wall 294 and defining an opening for the filter 288.

The pre-motor filter 288 includes an upstream side 304 and a downstream side 306. The upstream side 304 faces the air outlet 254, and the downstream side 306 opposes the upstream side 304 relative to the direction of airflow. In the illustrated embodiment, the filter 288 is flat and substantially uninterrupted, unlike ring-shaped filters which have a hole or opening defining the upstream side of the filter. The pre-motor filter 288 can comprise a foam filter or a HEPA filter. A foam filter has the advantage of being reusable with periodic cleaning.

Stand-offs 308 can be provided in the filter housing 292 to engage the upstream and/or downstream sides 304, 306 of the pre-motor filter 288 to secure the filter 288 in position. In the illustrated embodiment, the stand-offs 308 include ribs projecting about the peripheral side wall 296 of the housing 292. The stand-offs 308 define an upstream headspace or header 310 on the upstream side 304 of the pre-motor filter 288 that allows air flowing out of the air outlet 254 to travel upwardly and laterally between the stand-offs 308. A downstream headspace or header 312 on the downstream side 306 of the pre-motor filter 288 is formed by the open space between the underside of the lid 224 and the downstream side 306 of the pre-motor filter 288.

As shown in FIG. 8, the air outlet 254 can be formed one or more openings in the bottom wall 294 of the filter housing 292. The opening(s) forming the air outlet 254 can be provided in between the stand-offs 308, which can also function as partitions or dividers to direct working air to different portions of the filter 288. This spreads the working airflow more evenly across the filter 288 prevents one area of the filter 288 from becoming substantially dirtier more quickly than other areas of the filter 28.

The pre-motor filter 288 may be removably mounted in the filter chamber 290, such that the pre-motor filter 288 is removed through the top of the housing 220 for cleaning or replacement when the lid 224 is open, as shown in FIG. 8. Alternatively, the entire filter housing 292 may be removable from the first housing 220 so that a user need not directly touch the filter 288 to remove it from the vacuum cleaner 210.

When the lid 224 is open, the downstream side 306 of the pre-motor filter 288 is viewable by a user. Alternatively, the pre-motor filter assembly can be configured such that the upstream side 304 is visible when the lid 224 is open. For example, the pre-motor filter 288 may be coupled with the underside of the lid 224, such that the pre-motor filter 288 remains with the lid 224 when the lid 224 is open. This allows the user to immediately view the upstream side 304 and assess whether the pre-motor filter 288 should be cleaned or replaced. One example of such a filter arrangement is disclosed in U.S. Patent Application Publication No. 2015/0182085, published Jul. 2, 2015, incorporated above.

The air deflector 248 may be formed with or otherwise provided on the filter housing 292. In the illustrated embodiment, the air deflector 248 is formed as part of the peripheral side wall 296. Alternatively, the air deflector 248 may be separate from the filter housing 292. In yet another alternative, the air deflector 248 may be eliminated, and the air inlet 214 can be configured to direct air tangentially around the circumference of the chamber 246, as in the case of the debris removal assembly 218 including a cyclonic or centrifugal separator. In this case, a portion of the tangential air inlet 214 may be provided on the filter housing 292 or may be separate from the filter housing 292.

It is noted that in the illustrated embodiment, the debris removal assembly 218 is non-cyclonic, and that the debris removal assembly 218 includes both the air deflector 248 and the filter cup 240. In other embodiments, the debris removal assembly 218 can include only the air deflector 248 or only the filter cup 240. Other configurations of the debris removal assembly 218 are also possible. For example, the debris removal assembly 218 can include a cyclonic or centrifugal separator, a flexible and air-permeable filter bag, or other air filtering means.

Portions of the body 212 may be at least partially transparent or translucent in order to permit a user to view an interior portion of the body 212. For example, at least a portion of the exterior wall 244 may be formed of a transparent material, such as plastic, so that a user can determine the fullness of the filter cup 240 without having to remove the filter cup 240. Also, at least a portion of the lid 224 may be formed of a transparent material, such as plastic, so that a user can visually inspect the condition of the pre-motor filter 288 without having to open the lid 224.

Referring to FIG. 7, the motor/fan assembly 216 is provided in fluid communication with the debris removal assembly 218, and is positioned downstream of the debris removal assembly 218 and pre-motor filter assembly, within the motor housing 222. The vacuum collection system can also be provided with one or more additional filters (not shown) upstream or downstream of the motor/fan assembly 216.

The motor/fan assembly 216 includes a fan section 314 and a motor section 316 which are housed in the motor housing 222. The motor housing 222 further comprises an inlet 318 for passing air into the motor housing 222 and an outlet for exhausting substantially clean air from the vacuum cleaner 210. The motor housing inlet 318 may be located between the upper and lower ends of the first housing 220, and may preferably be below the air inlet 214, such as between the upper and lower ends of the filter cup 240. In the embodiment illustrated herein, the motor housing outlet is formed by one or more exhaust openings or grill 320 in the motor housing 222.

The working air path through the body 212 includes a portion connecting the air outlet 254 with the motor housing inlet 318 to the motor/fan assembly 216. This portion can include an air conduit 322 formed by the handle 230 which extends downstream of the downstream header 312 to the motor housing inlet 318. To form the air conduit, the handle 230 is at least partially hollow. As shown herein, the handle 230 may be substantially hollow between the upper end 234 and the lower end 236.

In the illustrated embodiment, the working air path connecting the air outlet 254 with the motor housing inlet 318 can further include the pre-motor filter assembly, as well as the upstream and downstream headers 310, 312. From the downstream header 312, air may flow through air conduit 322 in a generally downward direction and into the motor housing inlet 318.

The air conduit 322 may be formed with no bends less than 90 degrees so as to avoid drastic changes in air flow direction which would otherwise cause airflow restrictions and noise. In one example, the bends at the upper end 234 and lower end 236 of the handle 230 may be between 105 and 150 degrees.

It is noted that in order to prevent air leakage, seals or gaskets can be provided between various components of the vacuum cleaner 210, including but not limited to, at the interface between the lid 224 and first housing 220, at the interface between the filter cup 240 and the lower end of the housing 220, and/or at the interface between the motor/fan assembly 216 and the motor housing 222.

Figure 9:
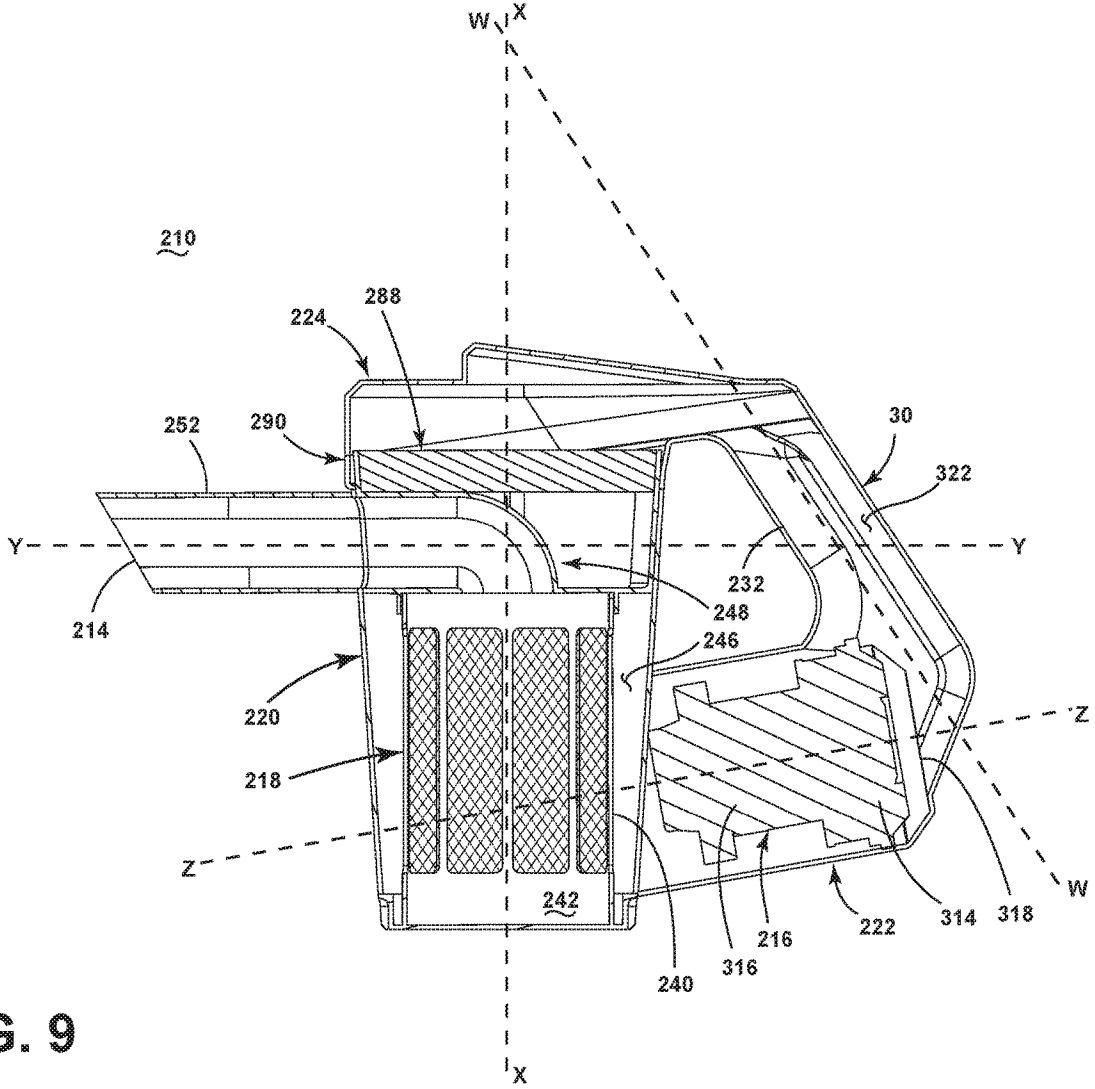
FIG. 9 is a side sectional view of the vacuum cleaner from FIG. 6A.

FIG. 9 is a side sectional view of the vacuum cleaner 210. The chamber 246 for the filter cup 240 defines a central longitudinal axis X. The central longitudinal axis X may pass through the interior 242 of the filter cup 240, and the filter cup 240 may be slid generally along the central longitudinal axis X when inserting or removing the filter cup 240. The pre-motor filter 288 can be provided above the chamber 246, with the central longitudinal axis X extending through the filter 288 and/or filter chamber 290. In the illustrated embodiment, the axis X extends through both the filter 288 and filter chamber 290.

In FIG. 9, the vacuum cleaner 210 is oriented with the central longitudinal axis X extending vertically. It is noted that this particular orientation is used as a reference point when discussing the other axes of the vacuum cleaner 210 for FIG. 9, and that in a normal operating position the vacuum cleaner 210 may be held at other orientations, such as, but not limited to, with the air inlet 214 pointing downwardly or at an angle; one example of a normal operating position is shown in FIG. 6B. With respect to the various axes discussed herein, the term "substantially" denotes that one axis may deviate from the described relationship by up to 20 degrees.

The air inlet conduit 252 can extend along an inlet axis Y that may be generally perpendicular to the central longitudinal axis X, and may further intersect the central longitudinal axis X. The air deflector 248 directs working air from the air inlet 214 downwardly within the filter cup 240, generally along the central longitudinal axis X. Thus, the incoming working airstream initially follows inlet axis Y, and is turned to generally follow the central longitudinal axis X by the air deflector 248.

The fan section 314 and motor section 316 of the motor/fan assembly 216 lie along a common motor axis Z. Air traveling through the motor/fan assembly 216 travels substantially parallel to the motor axis Z. The fan section 314 may be positioned rearward of and above the motor section 316 along the motor axis Z.

The motor axis Z may be generally vertical, horizontal or between vertical and horizontal. Broadly, the motor axis Z may range from 0-90 degrees relative to the central longitudinal axis X, with a motor axis Z at 0 degrees being generally parallel to the central longitudinal axis X and a motor axis Z at 90 degrees being generally perpendicular to the central longitudinal axis X. Preferably, the motor axis Z may be generally horizontal or inclined from horizontal. A more preferred range for the motor axis Z may be 60-90 degrees relative to the central longitudinal axis X.

It is noted that the motor housing inlet 318 may lie along the motor axis Z or may deviate from the motor axis Z. For example, the angle of the motor housing inlet 318 may range from 0-90 degrees relative to the central longitudinal axis X. Further, the motor housing inlet 318 may point generally upwardly or downwardly relative to the central longitudinal axis X.

The motor axis Z may intersect the central longitudinal axis X, or may be offset from the central longitudinal axis X. In the illustrated embodiment, the motor axis Z passes through the filter cup 240, with the intersection of the central longitudinal axis X occurring in the interior 242.

The grip portion 232 of the handle 230 may define a handle axis W. For a pistol-style grip, the handle axis W may be generally vertical, or inclined from the vertical. In the embodiment illustrated, the handle axis W is inclined forwardly from vertical and formed at an angle relative to the central longitudinal axis X. The angle may be approximately 0-45 degrees, and more preferably approximately 33 degrees as shown in the illustrated embodiment. The angled, pistol-style handle 230 positions the user's hand and wrist in an ergonomic position with more grip strength for holding the vacuum cleaner 210.

Together, the central longitudinal axis X, handle axis W, and motor axis Z define a triangle. As the motor/fan assembly 216 and the debris removal assembly 218 comprise the majority of the weight of the vacuum cleaner 210, moving the handle 230 closer to these components and arranging the handle 230 in a triangular relationship with these components decreases the distance between the handle 230 and the center of gravity of the vacuum cleaner 210. Moving the handle 230 closer to the center of gravity reduces the magnitude of downward forces and torque on a user's hand and wrist, which makes the vacuum cleaner 210 easier to handle and manipulate.

Figure 10:
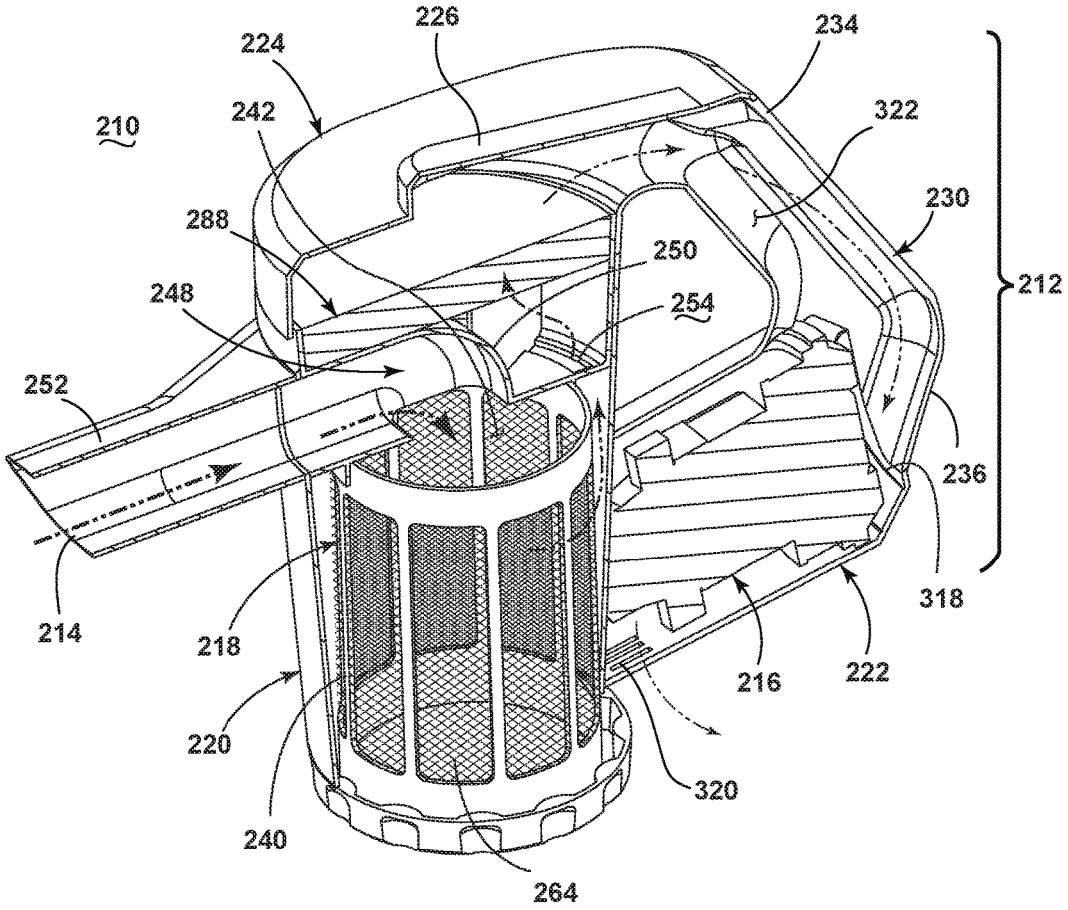
FIG. 10 is a partial cross-sectional view of the vacuum cleaner from FIG. 6A, showing a working air flow path through the vacuum cleaner.

The vacuum cleaner 210 shown in FIGS. 6A-10 can be used to effectively clean a surface by removing debris (which may include dirt, dust, soil, hair, and other debris) from the surface in accordance with the following method. Referring to FIG. 10 in particular, to perform vacuum cleaning, the motor/fan assembly 216 draws in debris-laden air through the air inlet 214 and into the debris removal assembly 218 where at least some or all debris in the working air is filtered out from the working airstream. As shown herein, a working airstream enters the air inlet 214 and is deflected downwardly by the air deflector 248 and into the filter cup 240. The air then passes through the screen 264 of the filter cup 240, with the screen 264 retaining at least debris from the working airstream. The air turns upwardly to exit the chamber 246 via the air outlet 254 and through the pre-motor filter 288. The air then passes generally rearwardly through the downstream header 312 and travels through the air conduit 322 in the handle 230 to the motor/fan assembly 216 via inlet 318. After passing through the motor/fan assembly 216, the air may exit the housing via the exhaust grill 320.

In some embodiments, a post-motor filter (not shown) may be provided between the outlet from the motor/fan assembly 216 and the exhaust grill 320. In this case, a portion of the second housing 222 may be configured to provide access to the post-motor filter for cleaning or replacement of the post-motor filter. The debris removal assembly 218 can be periodically emptied of debris by removing and emptying the filter cup 240. Likewise, the pre-motor filter 288, as well as any additional filters, can periodically be cleaned or replaced.

To the extent not already described, the different features and structures of the various embodiments of the handheld vacuum cleaner 10, may be used in combination with each other as desired, or may be used separately. That one vacuum cleaner is illustrated herein as having all of these features does not mean that all of these features must be used in combination, but rather done so here for brevity of description. Furthermore, while the vacuum cleaner 10 shown herein includes a vacuum collection system for creating a partial vacuum to suck up debris (which may include dirt, dust, soil, hair, and other debris) from a surface to be cleaned and collecting the removed debris in a space provided on the vacuum cleaner 10 for later disposal, in some embodiments of the invention, not illustrated herein, the vacuum cleaner 10 can additionally have fluid delivery capability, including applying liquid or steam to the surface to be cleaned, and/or fluid extraction capability. Still further, while the vacuum cleaner 10 shown herein is a handheld vacuum cleaner, features of the handheld vacuum cleaner 10 can alternatively be applied to upright-type, canister-type, or stick vacuum cleaners. Thus, the various features of the different embodiments may be mixed and matched in various vacuum cleaner configurations as desired to form new embodiments, whether or not the new embodiments are expressly described.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A handheld vacuum cleaner, comprising:

a hand-carriable body having an air inlet, an air outlet, and a handle extending away from the body and defining a handle opening between the body and the handle and where the handle is adapted to be gripped by a user;

a motor/fan assembly carried by the body upstream of the air outlet and in fluid communication with the air inlet for generating a working airstream;

a debris removal assembly carried by the body; and a working air path through the body from the air inlet to the air outlet and including the motor/fan assembly and the debris removal assembly;

wherein the handle is at least partially hollow to form an air conduit downstream of the debris removal assembly and upstream of the motor/fan assembly, and wherein a portion of the working air path extends through the air conduit formed by the handle toward an inlet of the motor/fan assembly.

2. The handheld vacuum cleaner of claim 1, wherein the handle has a first end, a second end, and a hand grip between the first and second ends, and wherein the working air path extends through the first and second ends.

3. The handheld vacuum cleaner of claim 2, wherein the handle is rigid between the first and second ends.

4. The handheld vacuum cleaner of claim 1, wherein the air conduit is formed with at least one bend that is greater than or equal to 90 degrees.

5. The handheld vacuum cleaner of claim 1 and further comprising a pre-motor filter assembly mounted to the body and defining a portion of the working air path, the pre-motor filter assembly comprising at least one pre-motor filter received within a filter chamber.

6. The handheld vacuum cleaner of claim 5, wherein the portion of the working air path that extends through the air conduit formed by the handle extends from the pre-motor filter assembly to the inlet of the motor/fan assembly.

7. The handheld vacuum cleaner of claim 1, wherein the hand-carriable body comprises a first housing for the debris removal assembly and a second housing for the motor/fan assembly, wherein the first and second housings are in fluid communication with each other and form a single, hand-carriable unit.

8. The handheld vacuum cleaner of claim 7, wherein the handle has a first end, a second end, and a hand grip between the first and second ends, and wherein the first end is coupled with the first housing and the second end is coupled with the second housing.

9. The handheld vacuum cleaner of claim 7 and further comprising a cover enclosing a top of the first housing and openable to provide access to the top of the first housing.

10. The handheld vacuum cleaner of claim 7, wherein the handle comprises a pistol-style grip with an upper end attached to the first housing and a lower end attached to the second housing.

11. The handheld vacuum cleaner of claim 1, wherein the debris removal assembly comprises:

a non-cyclonic debris removal assembly comprising a wall defining a chamber, an air deflector provided in the chamber, a debris separator provided in an upper portion of the chamber for separating contaminants from the working airstream, and a debris collector defined by a lower portion of the chamber for receiving and collecting separated contaminants;

wherein the air deflector is positioned in direct opposition to the air inlet and comprises a deflector wall that is shaped to direct the working airstream from the air inlet downwardly within the chamber.

12. The handheld vacuum cleaner of claim 1, wherein the debris removal assembly comprises:

a chamber in fluid communication with the air inlet; and an air deflector provided in the chamber in opposition to the air inlet and configured to direct air downwardly within the chamber;

wherein the air deflector comprises a deflector wall shaped to effect a change in the direction of the working airstream from the air inlet.

13. The handheld vacuum cleaner of claim 12, wherein the debris removal assembly further comprises a filter in the chamber for filtering contaminants from the working airstream.

14. The handheld vacuum cleaner of claim 13, wherein the deflector wall is formed with the filter.

15. The handheld vacuum cleaner of claim 13, wherein the filter comprises a filter cup for separating contaminants from the working airstream and collecting separated contaminants, wherein the filter cup defines an interior in which debris is collected.

16. The handheld vacuum cleaner of claim 13, wherein the debris removal assembly further comprises a debris collector defining a collection chamber below the air deflector.

17. The handheld vacuum cleaner of claim 16, wherein the body comprises an exterior wall defining the collection chamber for the debris collector, wherein the exterior wall includes an openable lower section forming an openable door for emptying the collection chamber.

18. A handheld vacuum cleaner, comprising:

a hand-carriable body having an air inlet, an air outlet, and a handle extending away from the body and defining a handle opening between the body and the handle and where the handle is adapted to be gripped by a user, and wherein the handle is at least partially hollow to form an air conduit;

a motor/fan assembly carried by the body upstream of the air outlet and in fluid communication with the air inlet for generating a working airstream; a debris removal assembly carried by the body;

a working air path through the body from the air inlet to the air outlet and including the motor/fan assembly and the debris removal assembly, wherein a portion of the working air path extends through the air conduit formed by the handle; and a pre-motor filter assembly mounted to the body and defining a portion of the working air path, the pre-motor filter assembly comprising at least one pre-motor filter received within a filter chamber;

wherein the air conduit formed by the handle extends downstream from the premotor filter assembly to an inlet of the motor/fan assembly.

* * * * *